US010253945B2

(12) United States Patent
Jungwirth

(10) Patent No.: US 10,253,945 B2
(45) Date of Patent: Apr. 9, 2019

(54) SEARCHLIGHTS WITH DIFFUSERS FOR UNIFORMLY PROJECTING LIGHT

(71) Applicant: THE BOEING COMPANY, Chicago, IL (US)

(72) Inventor: Douglas R. Jungwirth, Chicago, IL (US)

(73) Assignee: The Boeing Company, Chicago, IL (US)

( * ) Notice: Subject to any disclaimer, the term of this patent is extended or adjusted under 35 U.S.C. 154(b) by 56 days.

(21) Appl. No.: 14/568,939

(22) Filed: Dec. 12, 2014

(65) Prior Publication Data

US 2016/0169473 A1 Jun. 16, 2016

(51) Int. Cl.

| | |
|---|---|
| ***F21V 5/00*** | (2018.01) |
| ***F21V 3/04*** | (2018.01) |
| ***F21S 8/00*** | (2006.01) |
| ***F21V 13/10*** | (2006.01) |
| *F21W 131/10* | (2006.01) |

(52) U.S. Cl.

CPC ..... *F21V 3/049* (2013.01); *F21S 8/003* (2013.01); *F21V 13/10* (2013.01); *F21W 2131/10* (2013.01)

(58) Field of Classification Search

CPC ..... F21V 5/002; F21V 5/003; F21V 5/004; F21V 5/005; F21V 5/048

See application file for complete search history.

(56) References Cited

U.S. PATENT DOCUMENTS

| | | | | | |
|---|---|---|---|---|---|
| 1,880,399 | A * | 10/1932 | Benjamin | F21V 7/0025 | 362/277 |
| 4,447,865 | A * | 5/1984 | VanHorn | F21V 7/09 | 362/297 |
| 4,712,167 | A * | 12/1987 | Gordin | B60Q 1/245 | 362/233 |
| 4,729,077 | A * | 3/1988 | Gordin | F21V 7/22 | 362/263 |
| 5,629,996 | A * | 5/1997 | Rizkin | B64F 1/20 | 359/15 |
| 5,655,832 | A * | 8/1997 | Pelka | F24J 2/06 | 362/259 |
| 5,808,759 | A * | 9/1998 | Okamori | G02B 5/0252 | 348/E9.027 |
| 6,048,081 | A * | 4/2000 | Richardson | F21S 10/00 | 359/353 |
| 6,252,338 | B1 * | 6/2001 | Bergman | F21V 7/09 | 313/110 |
| 6,352,359 | B1 * | 3/2002 | Shie | F21S 48/1233 | 362/331 |
| 6,502,961 | B1 * | 1/2003 | Richardson | F21V 5/04 | 362/268 |
| 6,565,233 | B1 * | 5/2003 | Richardson | F21V 5/00 | 362/246 |
| 6,586,864 | B2 * | 7/2003 | Zhou | H01J 61/025 | 313/110 |
| 7,131,749 | B2 * | 11/2006 | Wimberly | F21V 13/04 | 362/297 |

(Continued)

*Primary Examiner* — Ismael Negron

(74) *Attorney, Agent, or Firm* — Haynes and Boone, LLP

(57) ABSTRACT

A searchlight including at least one diffuser for eliminating spatial non-uniformities in the illuminated beam. The searchlight may further include a reflector, with the diffuser(s) positioned in front of the reflector.

20 Claims, 7 Drawing Sheets

(56) References Cited

U.S. PATENT DOCUMENTS

| | | | | |
|---|---|---|---|---|
| 7,506,998 | B2 * | 3/2009 | Ansems | G02B 6/002 362/245 |
| 8,123,381 | B1 * | 2/2012 | Wray | F21V 5/003 362/294 |
| 8,240,875 | B2 * | 8/2012 | Roberts | F21V 5/002 362/217.05 |
| 8,931,939 | B2 * | 1/2015 | Melzner | F21V 5/002 362/244 |
| 2007/0051883 | A1 * | 3/2007 | Rains, Jr. | F21S 2/00 250/228 |
| 2008/0062686 | A1 * | 3/2008 | Hoelen | G02B 6/002 362/240 |
| 2008/0117626 | A1 * | 5/2008 | Dean | B64D 47/04 362/231 |
| 2014/0168963 | A1 * | 6/2014 | Stone | F21S 8/08 362/231 |
| 2016/0047515 | A1 * | 2/2016 | Stone | F21K 9/56 362/553 |

* cited by examiner

SEARCHLIGHTS WITH DIFFUSERS FOR UNIFORMLY PROJECTING LIGHT

FIELD

The present disclosure relates to searchlights. In particular, it relates to diffuser techniques for searchlights.

BACKGROUND

Searchlights typically have spatial non-uniformities in the output beam that produce shadows and "donut holes" in the center of the beam (e.g., a round shadow in the center of the illuminated beam). These shadows in the beam are not desired for some projection applications and, as such, it would be beneficial if they were eliminated from the beam. Currently, some searchlights employ reimaging systems to at least partially reduce the shadows in the beam. However, with the use of a reimaging system, there is a large loss in the output of the beam (e.g., a greater than fifty percent (>50%) loss in output illumination).

As such, there is a need for a technique for improving illumination from a searchlight, without incurring a large loss in the output illumination.

SUMMARY

The present disclosure relates to a method, system, and apparatus for diffuser techniques for searchlights. In one or more embodiments, a method for improving illumination from a searchlight involves radiating, from the searchlight, light to produce an illuminated beam. The method further involves passing, through at least one diffuser, the light, thereby diffusing the illuminated beam.

In one or more embodiments, at least one diffuser is located in front of a reflector of the searchlight. In at least one embodiment, the reflector is a parabolic reflector or a non-parabolic reflector. In some embodiments, the non-parabolic reflector is a converging reflector or a diverging reflector.

In at least one embodiment, the searchlight is housed within a housing. In one or more embodiments, at least one diffuser is located within the housing of the searchlight. In some embodiments, at least one diffuser is located external to the housing of the searchlight.

In one or more embodiments, at least one diffuser a holographic diffuser, a fly's eye diffuser, and/or a Fresnel lens.

In at least one embodiment, at least one diffuser is a symmetric diffuser. In some embodiments, the symmetric diffuser has a diffusion angle of approximately zero (0) degrees to approximately six (6) degrees.

In one or more embodiments, at least one diffuser is an asymmetric diffuser. In some embodiments, the asymmetric diffuser has a diffusion angle from approximately zero (0) degrees to approximately ten (10) degrees. In at least one embodiment, the asymmetric diffuser has a diffusion angle in a vertical direction or a horizontal direction.

In one or more embodiments, an apparatus for improving illumination from a searchlight involves the searchlight to radiate light to produce an illuminated beam. The apparatus further involves at least one diffuser to pass the light through, thereby diffusing the illuminated beam.

In at least one embodiment, a system for improving illumination from a searchlight involves the searchlight to radiate light to produce an illuminated beam. The system further involves at least one diffuser to pass the light through, thereby diffusing the illuminated beam.

The features, functions, and advantages can be achieved independently in various embodiments of the present disclosure or may be combined in yet other embodiments.

DRAWINGS

These and other features, aspects, and advantages of the present disclosure will become better understood with regard to the following description, appended claims, and accompanying drawings where:

DESCRIPTION

Figure 1:
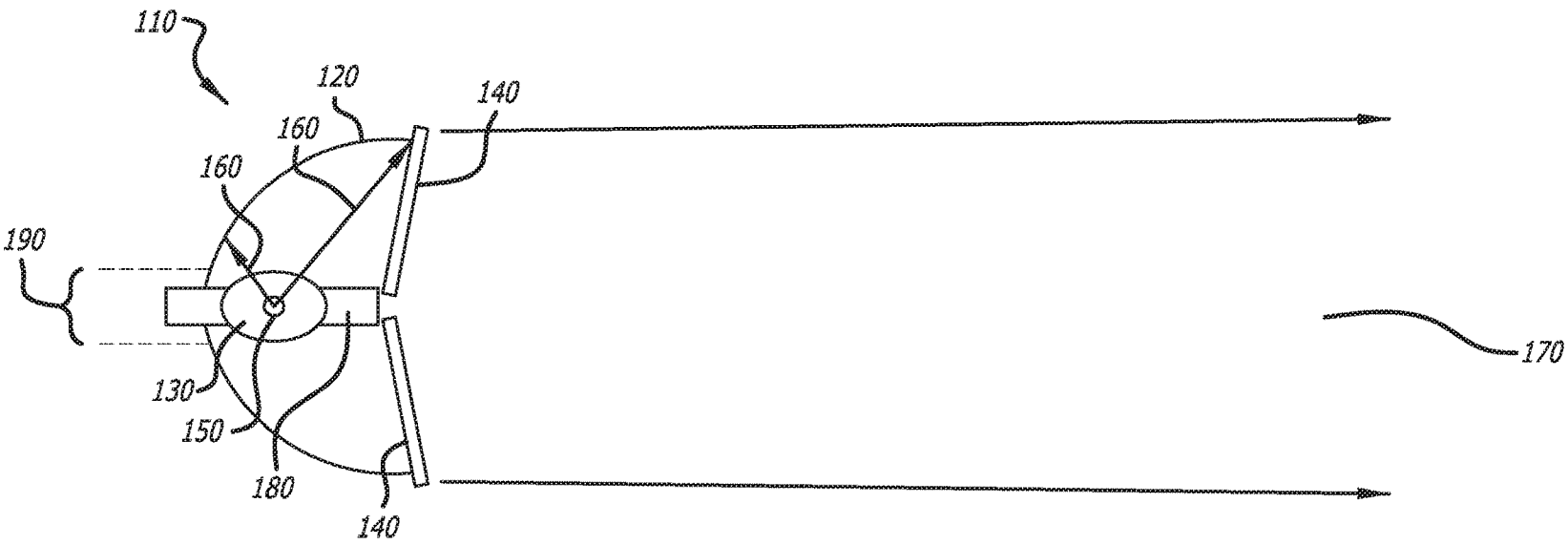
FIG. 1 (Prior Art)
FIG. 1 is a diagram showing a conventional exemplary searchlight.

The methods and apparatus disclosed herein provide an operative system for diffuser techniques for searchlights. The disclosed system introduces at least one diffuser element into the output beam of a searchlight system to diffuse the beam sufficiently to fill in the spatial non-uniformities that are not desired in illumination beams for some projection applications.

As previously mentioned above, searchlights typically have spatial non-uniformities in the output beam that produce shadows and "donut holes" in the center of the beam (e.g., a round shadow in the center of the illuminated beam). These shadows are most obvious when the searchlight is defocused to produce a larger illuminated beam pattern. Sometimes the shadows are caused by the searchlight's lamp, which is usually mounted in the middle of the reflector of the searchlight. The shadows may also be caused by the mechanical struts of the searchlight that hold an end of the lamp in place, and provide a current path for the lamp. Additionally, when the lamp is misaligned and/or defocused, there is a natural dark shadow (or "donut hole") that appears, as the different parts of the beam do not efficiently overlap as the beam propagates.

The shadows in the beam of the searchlight are not desired in some projection applications and, thus, it would be beneficial if they were eliminated from the beam. Some existing searchlights currently employ reimaging systems to at least partially reduce the shadows in the beam. However, with the use of a reimaging system, there is a large loss in the output of the searchlight beam.

In the present disclosure, at least one diffuser element is introduced into the optical train at the output of the searchlight that uniformly diffuses the light so that the dark spots (i.e. shadows) in the beam are filled in or overlapped by brighter portions of the original beam. In one or more embodiments, a holographic diffuser is employed, for at least one of the diffusers, that has a small diffusion angle. One such example of a diffuser that may be employed for at least one of the diffusers is holographic diffuser model no. K5U3MD25 manufactured by LUMINIT of Torrance, Calif. The addition of at least one diffuser element at the output of the searchlight produces the following effects: (1) an increase in the divergence angle of the overall illuminated output beam by the diffusion angle of the element, (2) the filling in of the bright and dark patches that are naturally occurring in the output beam, and (3) an elimination of the "donut hole" shadow by filling the hole in with diffuse light from the surrounding beam pattern.

In the following description, numerous details are set forth in order to provide a more thorough description of the system. It will be apparent, however, to one skilled in the art, that the disclosed system may be practiced without these specific details. In the other instances, well known features have not been described in detail so as not to unnecessarily obscure the system.

Embodiments of the present disclosure may be described herein in terms of functional and/or logical components and various processing steps. It should be appreciated that such components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with, and that the system described herein is merely one example embodiment of the present disclosure.

For the sake of brevity, conventional techniques and components related to searchlights, and other functional aspects of the system (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

FIG. 1 is a diagram 100 showing a conventional exemplary searchlight 110. In this figure, the searchlight 110 is shown to include a reflector 120, a lamp 130, and a mechanical frame 140. The reflector 120 of a conventional exemplary searchlight 110 may be a parabolic reflector or a non-parabolic reflector. When the reflector 120 is a non-parabolic reflector, it may be a converging reflector, which has a converging surface, or a diverging reflector, which has a diverging surface.

The lamp 130 is typically a glass-blown lamp. There are an inert gas (e.g., a Xenon gas) and two electrodes (not shown), which are separated from one another by a gap, housed inside of the lamp 130. During operation of the searchlight 110, a voltage (e.g., 25K volts) is put across the electrodes to ignite the lamp 130, thus allowing a voltage to create an arc 150. The electric current heats and maintains the arc 150 across the gap between the electrodes. The temperature of the arc 150 in the lamp 130 can reach several thousand degrees Celsius (C) (e.g., 5,000 degrees C.). The electrodes are heated to incandescence. Light 160 is produced by the arc 150 between electrodes through the inert gas inside of the lamp 130. The light 160 reflects off of the reflector 120 to produce an illuminated beam (i.e. an output beam) 170 of the searchlight 110.

The mechanical frame 140 may comprise a plurality of struts (e.g., three struts), which are used to hold an end 180 of the lamp 130 in place and to provide a current path for the lamp 130.

The struts of the mechanical frame 140 of the searchlight 110 can cause shadows in the illuminated beam 170 of the searchlight 110. In addition, the lamp 130 can also cause of "donut hole" shadow in the center of the illuminated beam 170 of the searchlight 110 (e.g., the lamp 130 produces a shadow area 190 of the lamp 130 off of the reflector 120).

Figure 2:
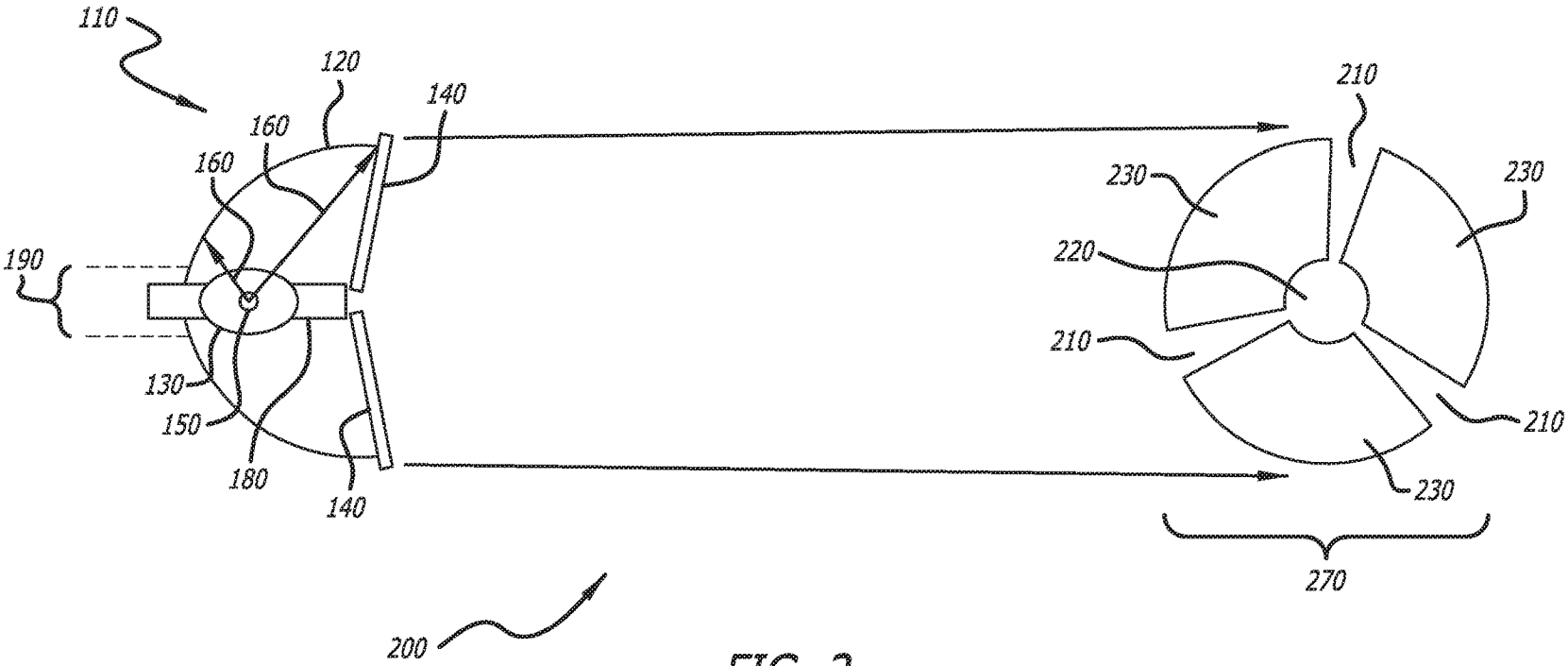
FIG. 2 (Prior Art)
FIG. 2 is a diagram illustrating the searchlight of FIG. 1 illuminating a focused beam.

FIG. 2 is a diagram 200 illustrating the searchlight 110 of FIG. 1 illuminating a focused beam 270. In this figure, the searchlight 110 is shown to be illuminating a beam 270 that includes mechanical frame shadows 210 that are produced by the mechanical frame 140 (e.g., produced by three struts of the mechanical frame), and a lamp shadow 220 (i.e. "donut hole" shadow) that is produced by the lamp 130. As such, the resultant cross section of the illuminated beam 270 comprises three bright illuminated areas 230, and looks like a donut with three slits radiating out from its center.

Figure 3:
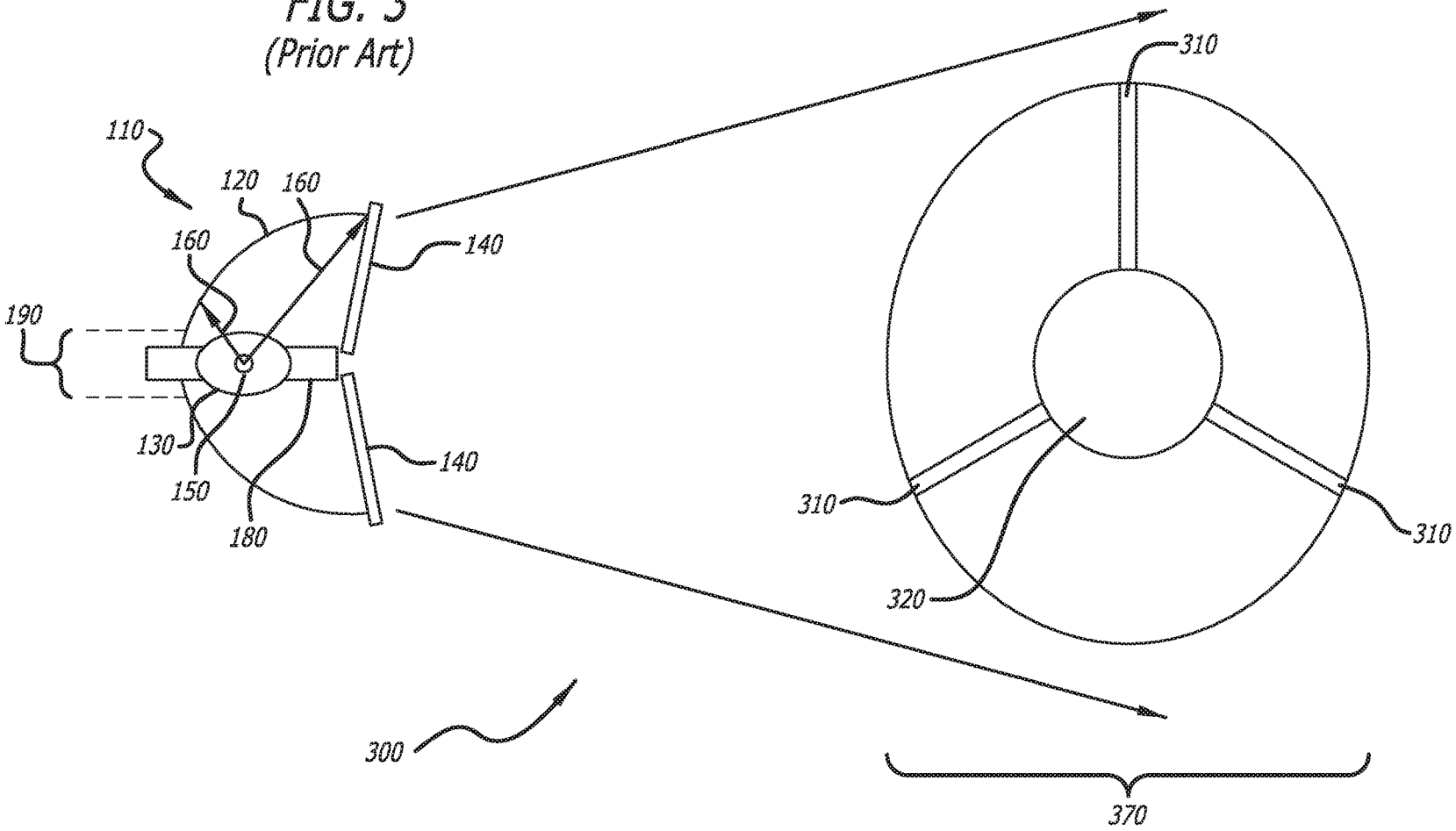
FIG. 3 (Prior Art)
FIG. 3 is a diagram illustrating the searchlight of FIG. 1 illuminating a defocused beam.

FIG. 3 is a diagram 200 illustrating the searchlight 110 of FIG. 1 illuminating a defocused beam 370. In this figure, the defocused beam 370 is shown to be larger than the focused beam 270 of FIG. 2. In addition, as a result of the defocusing, the beam 370 is diffused such that light diffuses into the mechanical frame shadows 310 and into the lamp shadow 320. As such, the resultant cross section of the illuminated beam 370 shows that the shadows 310, 320 have been brightened, as compared to the shadows 210, 220 of the illuminated beam 270 of FIG. 2.

Figure 4:
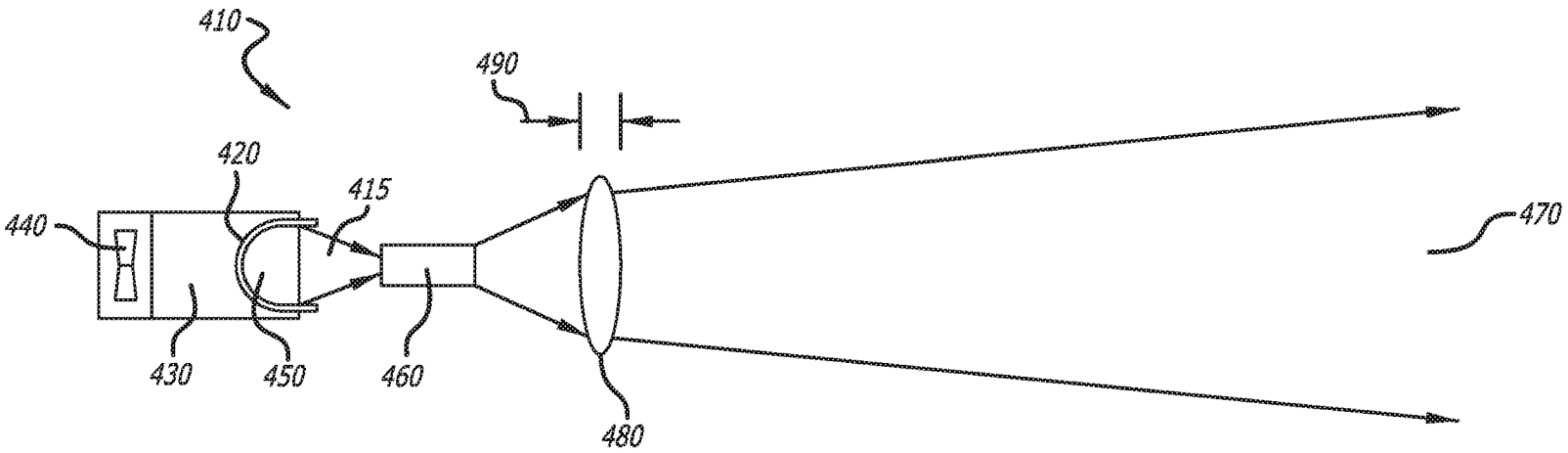
FIG. 4 (Prior Art)
FIG. 4 is a diagram showing a conventional exemplary searchlight employing a reimaging system to diffuse the illuminated beam.

FIG. 4 is a diagram 400 showing a conventional exemplary searchlight 410 employing a reimaging to diffuse the illuminated beam. In this figure, the searchlight 410 is shown to include an arc lamp source 430. The arc lamp source 430 includes a reflector 420, that reflects light generated from the arc 450, to produce an illuminated beam 470. The searchlight 410 is also shown to include a fan 440 to aid in cooling the arc lamp source 430.

For this design, a homogenizer 460 is included between the light source (i.e. the searchlight 410) and final optical elements (e.g., a lens 480) that collimate the beam 415 from the searchlight 410, and direct the illuminated beam 470 to a target. The lens 480 is moved according to the directions indicated by arrows 490 to focus the illuminated beam 470. The homogenizer 460 redistributes the intensity of the beam 415 from the searchlight 410 to a more uniform illumination pattern of the illuminated beam 470, thereby eliminating the dark shadow (i.e. "donut hole" shadow) in the middle of the illuminated beam 470.

Examples of a commercially available searchlights that employ reimaging are searchlights manufactured by TRAKKA CORP in Victoria, Australia. However, as previously mentioned above, it should be noted that a disadvantage of using a reimaging system for a searchlight is that there is a large loss in the output of the beam of the searchlight (e.g., a greater than fifty percent (>50%) loss in output illumination).

Figure 5:
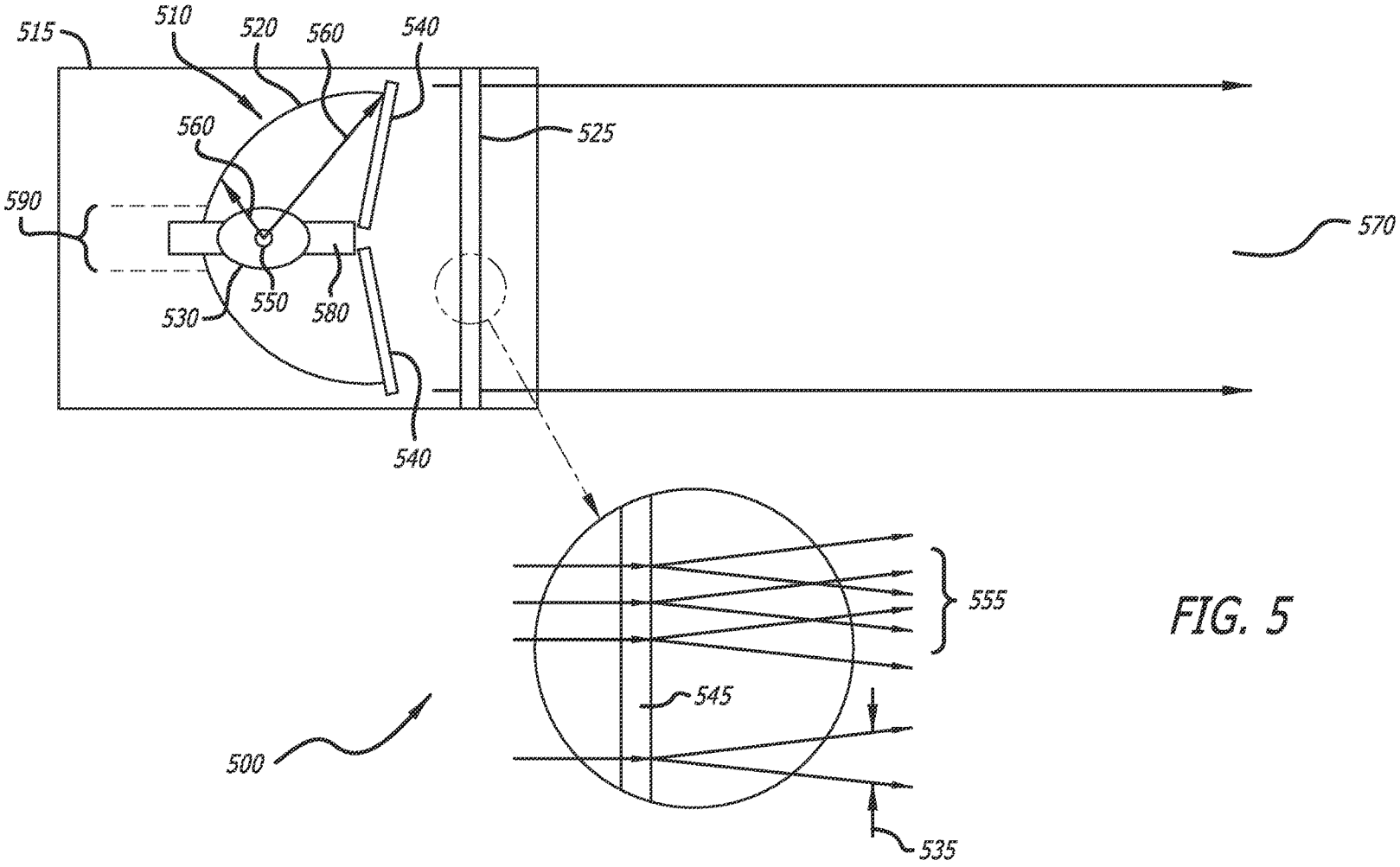
FIG. 5 is a diagram showing a searchlight employing the disclosed diffusing techniques, in accordance with at least one embodiment of the present disclosure.

FIG. 5 is a diagram 500 showing a searchlight 510 employing the disclosed diffusing techniques, in accordance with at least one embodiment of the present disclosure. It should be noted that the searchlight 510 itself is similar to the searchlight 110 of FIG. 1.

In this figure, the searchlight 510 is shown to include a reflector 520, a lamp 530, and a mechanical frame 540. The reflector 520 of the searchlight 510 may be a parabolic reflector or a non-parabolic reflector. When the reflector 520 is a non-parabolic reflector, it may be a converging reflector or a diverging reflector.

The lamp 530 may be a glass-blown lamp. There are an inert gas (e.g., a Xenon gas) and two electrodes (not shown) housed inside of the lamp 530. The two electrodes are separated from one another by a gap. During operation of the searchlight 510, a voltage (e.g., 25K volts) is put across the electrodes to ignite the lamp 530, thereby allowing a voltage to create an arc 550. The electric current heats and maintains the arc 550 across the gap between the electrodes. The temperature of the arc 550 in the lamp 530 can reach several thousand degrees Celsius (C) (e.g., 5,000 degrees C.). The electrodes are heated to incandescence. Light 560 is produced by the arc 550 between electrodes through the inert gas inside of the lamp 530. The light 560 reflects off of the reflector 520 to produce an illuminated beam (i.e. an output beam) 570 of the searchlight 510.

The mechanical frame 540 may comprise a plurality of struts (e.g., three struts), which are used to hold an end 580 of the lamp 530 in place and to provide a current path for the lamp 530. The struts of the mechanical frame 540 of the searchlight 510 can cause shadows in the illuminated beam 570 of the searchlight 510. In addition, the lamp 530 can also cause of "donut hole" shadow in the center of the illuminated beam 570 of the searchlight 510 (e.g., the lamp 530 produces a shadow area 590 of the lamp 530 off of the reflector 520).

Also in this figure, the searchlight 510 is shown to be housed within a housing 515 (e.g., a searchlight housing). A diffuser 525 (e.g., a holographic diffuser) is placed in front of the reflector 520 of the searchlight 510 and within the housing 515. It should be noted that in other embodiments, the diffuser 525 may be located external to the housing 515, so long as the diffuser 525 remains in front of the reflector 520. It should also be noted that in some embodiments, more than one diffuser 525 may be employed.

In one or more embodiments, the diffuser 525 may be a holographic diffuser, a fly's eye diffuser, and a Fresnel lens. And, if more than one diffuser 525 is employed, different types of diffusers may be employed together.

In addition, in one or more embodiments, the diffuser 525 may be a symmetric diffuser or an asymmetric diffuser. The symmetric diffuser may have a diffusion angle 535 of approximately zero (0) degrees to approximately six (6) degrees. The asymmetric diffuser may have a diffusion angle 535 of approximately zero (0) degrees to approximately ten (10) degrees. In addition, the asymmetric diffuser can have its diffusion angle in the horizontal direction or the vertical direction.

During operation of the searchlight 510, light is reflected off the reflector 520 and passes through the diffuser 525, thereby diffusing the illuminated beam 570. Each light beam 545 input into the diffuser 525 gets diffused at the diffuser's 525 surface. Light beams 555 output from the diffuser 525 overlap to smooth out the spatial profile of the illuminated beam 570.

Figure 6:
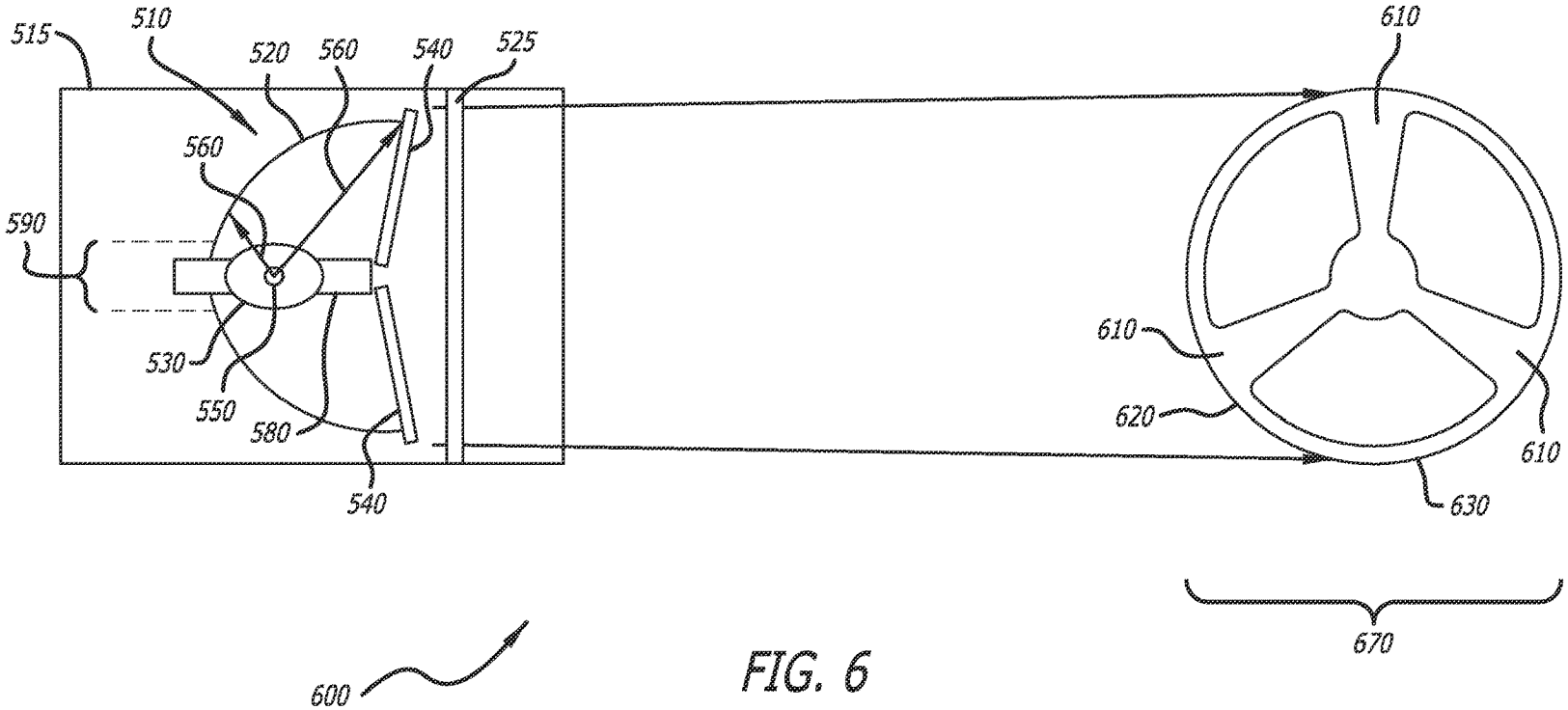
FIG. 6 is a diagram showing the searchlight of FIG. 5 illuminating a focused beam, in accordance with at least one embodiment of the present disclosure.

FIG. 6 is a diagram 600 showing the searchlight 510 of FIG. 5 illuminating a focused beam 670, in accordance with at least one embodiment of the present disclosure. As a result of the diffusion of the light beams 545 (refer to FIG. 5) from the reflector 510, the illuminated beam 670 is diffused such that light diffuses into the mechanical frame shadows 610 and into the lamp shadow 620 and such that the illuminated beam 670 pattern is slightly larger 630 than without using a diffuser 525. As such, the resultant cross section of the illuminated beam 670 shows that the shadows 610, 620 have been at least partially filled in with light.

Figure 7:
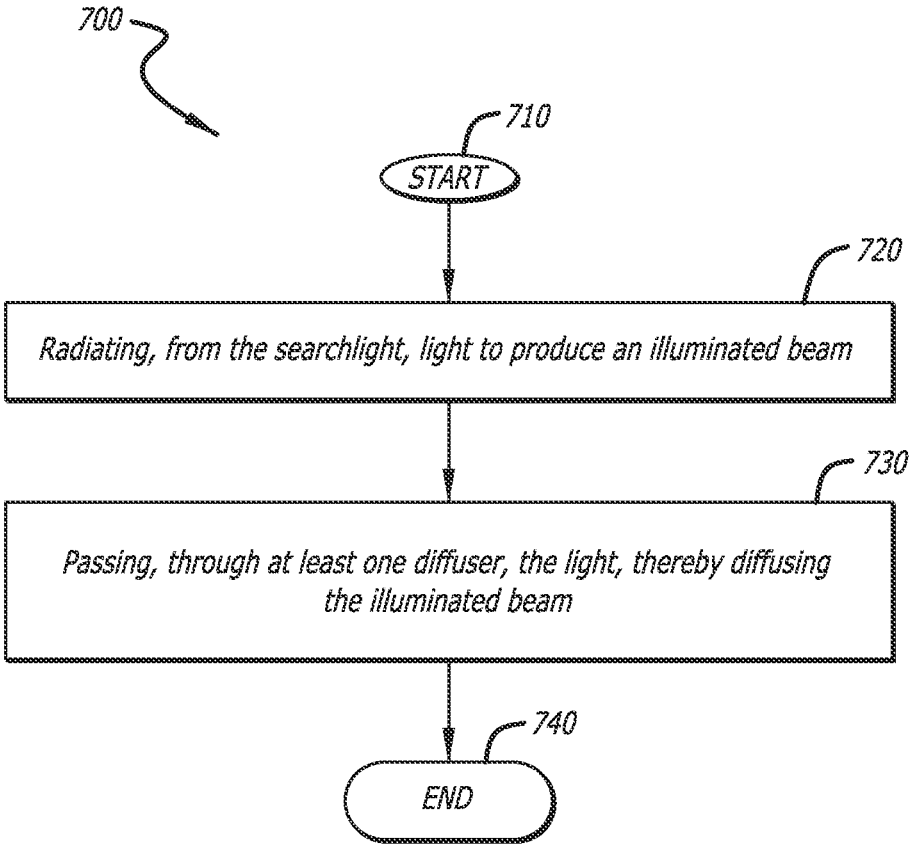
FIG. 7 depicts a flow chart depicting the disclosed method for improving illumination from a searchlight, in accordance with at least one embodiment of the present disclosure.

FIG. 7 depicts a flow chart depicting the disclosed method 700 for improving illumination from a searchlight, in accordance with at least one embodiment of the present disclosure. At the start 710 of the method 700, the searchlight radiates light to produce an illuminated beam 720. The light passes through at least one diffuser, thereby diffusing the illuminated beam 730. Then, the method 700 ends 740.

Although particular embodiments have been shown and described, it should be understood that the above discussion is not intended to limit the scope of these embodiments. While embodiments and variations of the many aspects of the present disclosure have been disclosed and described herein, such disclosure is provided for purposes of explanation and illustration only. Thus, various changes and modifications may be made without departing from the scope of the claims.

Where methods described above indicate certain events occurring in certain order, those of ordinary skill in the art having the benefit of this disclosure would recognize that the ordering may be modified and that such modifications are in accordance with the variations of the present disclosure. Additionally, parts of methods may be performed concurrently in a parallel process when possible, as well as performed sequentially. In addition, more parts or less part of the methods may be performed.

Accordingly, embodiments are intended to exemplify alternatives, modifications, and equivalents that may fall within the scope of the claims.

Although certain illustrative embodiments and methods have been disclosed herein, it can be apparent from the foregoing disclosure to those skilled in the art that variations and modifications of such embodiments and methods can be made without departing from the true spirit and scope of the art disclosed. Many other examples of the art disclosed exist, each differing from others in matters of detail only. Accordingly, it is intended that the art disclosed shall be limited only to the extent required by the appended claims and the rules and principles of applicable law.

I claim:

1. A searchlight apparatus for improving illumination from the searchlight by filling-in spatial non-uniformities in an illuminated beam, the apparatus comprising:

a lamp of the searchlight to radiate white light, which is produced by an arc generated between electrodes through a Xenon gas inside of the lamp, wherein the white light produces the illuminated beam comprising the spatial non-uniformities in the form of shadows; and at least one diffuser, which comprises a white light holographic diffuser, located in front of the lamp and a reflector of the searchlight, to receive and to pass the white light through to diffuse the illuminated beam such that the white light diffuses into the shadows in the illuminated beam and the illuminated beam is larger in size than without using the at least one diffuser, wherein the at least one diffuser is a symmetric diffuser with a diffusion angle of approximately zero (0) degrees to approximately six (6) degrees or an asymmetric diffuser with a diffusion angle from approximately zero (0) degrees to approximately ten (10) degrees.

2. The apparatus of claim 1, wherein the reflector is a parabolic reflector.

3. The apparatus of claim 1, wherein the reflector is one of a converging reflector or a diverging reflector.

4. The apparatus of the claim 1, wherein the searchlight is housed within a housing.

5. The apparatus of claim 4, wherein the at least one diffuser is located within the housing of the searchlight.

6. A system for improving illumination from a searchlight by filling-in spatial non-uniformities in an illuminated beam, the system comprising:

a lamp of the searchlight to radiate white light, which is produced by an arc generated between electrodes through a Xenon gas inside of the lamp, wherein the white light produces the illuminated beam comprising the spatial non-uniformities in the form of shadows;

at least one diffuser, which comprises a white light holographic diffuser, located in front of the lamp and a reflector of the searchlight, to receive and to pass the white light through to diffuse the illuminated beam such that the white light diffuses into the shadows in the illuminated beam and the illuminated beam is larger in size than without using the at least one diffuser, wherein the at least one diffuser is a symmetric diffuser with a diffusion angle of approximately zero (0) degrees to approximately six (6) degrees or an asymmetric diffuser with a diffusion angle from approximately zero (0) degrees to approximately ten (10) degrees; and a housing comprising the searchlight.

7. The system of claim 6, wherein the reflector is a parabolic reflector.

8. The system of claim 6, wherein the reflector is one of a converging reflector or a diverging reflector.

9. A method for improving illumination from a searchlight by filling-in spatial non-uniformities in an illuminated beam, the method comprising:

radiating, from a lamp of the searchlight, white light, which is produced by an arc generated between electrodes through a Xenon gas inside of the lamp, wherein the white light produces the illuminated beam comprising the spatial non-uniformities in the form of shadows; and receiving by and passing through at least one diffuser, which comprises a white light holographic diffuser, located in front of the lamp and a reflector of the searchlight, the white light to diffuse the illuminated beam such that the white light diffuses into the shadows in the illuminated beam and the illuminated beam is larger in size than without using the at least one diffuser.

10. The method of claim 9, wherein the reflector is a parabolic reflector.

11. The method of claim 9, wherein the reflector is one of a converging reflector or a diverging reflector.

12. The method of claim 9, wherein the method further comprises receiving by and passing through at least one Fresnel lens, located in front of the lamp and the reflector of the searchlight, the white light.

13. The method of claim 9, wherein at least one of the at least one diffuser is a symmetric diffuser.

14. The method of claim 13, wherein the symmetric diffuser has a diffusion angle of approximately zero (0) degrees to approximately six (6) degrees.

15. The method of the claim 9, wherein the searchlight is housed within a housing.

16. The method of claim 15, wherein the at least one diffuser is located within the housing of the searchlight.

17. The method of claim 15, wherein the at least one diffuser is located external to the housing of the searchlight.

18. The method of claim 9, wherein at least one of the at least one diffuser is an asymmetric diffuser.

19. The method of claim 18, wherein the asymmetric diffuser has a diffusion angle from approximately zero (0) degrees to approximately ten (10) degrees.

20. The method of claim 18, wherein the asymmetric diffuser has a diffusion angle in one of a vertical direction and a horizontal direction.

* * * * *